US006732661B2

(12) United States Patent
Grasse et al.

(10) Patent No.: US 6,732,661 B2
(45) Date of Patent: May 11, 2004

(54) MOVING TABLE FLAP

(75) Inventors: Klaus-Peter Grasse, Waldshut (DE); Manfred Flum, Waldshut-Tiengen (DE); Harry Fischer, Degernau (DE)

(73) Assignee: Sedus Stoll AG, Waldshut (DE)

( * ) Notice: Subject to any disclaimer, the term of this patent is extended or adjusted under 35 U.S.C. 154(b) by 0 days.

(21) Appl. No.: 10/260,512

(22) Filed: Oct. 1, 2002

(65) Prior Publication Data

US 2003/0070592 A1 Apr. 17, 2003

(30) Foreign Application Priority Data

Oct. 11, 2001 (DE) ..... 101 50 013

(51) Int. Cl.[7] ..... A47B 37/00
(52) U.S. Cl. ..... 108/50.02
(58) Field of Search ..... 108/50.02, 50.01, 108/23, 1, 3, 6; 312/223.6

(56) References Cited

U.S. PATENT DOCUMENTS 4,762,072 A * 8/1988 Boundy et al. ..... 108/50.02
4,792,881 A * 12/1988 Wilson et al. ..... 361/827
4,838,175 A * 6/1989 Hauville ..... 108/25
5,230,552 A * 7/1993 Schipper et al. ..... 312/223.6
5,709,156 A * 1/1998 Gevaert et al. ..... 108/50.02
5,878,673 A * 3/1999 Kramer et al. ..... 108/50.02
5,931,103 A * 8/1999 Huang ..... 108/50.02
6,162,071 A 12/2000 Muller

FOREIGN PATENT DOCUMENTS

| | | |
|---|---|---|
| DE | 40 09 536 | 9/1991 |
| DE | 195 00 525 | 7/1996 |
| DE | 198 48 672 | 4/2000 |
| DE | 200 10 748 | 10/2000 |
| EP | 0010277 | * 10/1979 |

* cited by examiner

*Primary Examiner*—Jose V. Chen
(74) *Attorney, Agent, or Firm*—Oblon, Spivak, McClelland, Maier & Neustadt, P.C.

(57) ABSTRACT

A movable table flap that which can be integrated into a work surface of a table, wherein in a closed position the upper side of the table flap is flush with the work surface of the table and a device for connecting various electric appliances and communication facilities is arranged underneath the table flap, wherein in the open position, the table flap can be both inclined and recessed simultaneously. The position of the table flap is changed by use of a compression spring, which is movable in an arched guide slot.

10 Claims, 7 Drawing Sheets

MOVING TABLE FLAP

TECHNICAL FIELD

This invention relates to the field of the furniture industry. It concerns a moving table flap that can be integrated into the work surface of a table. In the closed position the upper side of the table flap is flush with the work surface of the table, while in the open position the table flap allows the use of a device attached to its underside for connecting various electric appliances and communication facilities.

STATE OF THE ART

Today's workplace incorporates many kinds of electrical devices, most notably computers and communication facilities. For instance, many computers may be networked together. Furthermore, they may be connected to printers, remote storage devices, video interfaces, etc., which increase productivity and communicative capacity in the workplace.

All such devices require electric power and/or communication cables. In a permanent workplace power supply and interface cabling can be installed and bundled, but this tends to be unsightly, or there may not be enough space available.

In temporary workplaces—mainly used by different people and in which portable devices (e.g. laptop computers) are used as well—the situation is worsened by the fact that connecting such devices to power supply and interface cables is cumbersome and time consuming in most cases.

Recessing receptacles directly into the work surface of a table has recently become common. The cabling is connected to such receptacles perpendicular to the work surface. To reach them, users often have to lean uncomfortably over the table. Another existing method consists of providing table work surfaces with openings through which electric receptacles can be pulled out vertically. After the cables have been connected, such receptacles protrude into the workspace and can be intrusive.

In order to overcome these disadvantages U.S. Pat. No. 6,162,071 suggested an electrical receptacle adapted to be recessed into a work surface. This receptacle comprises a concealed compartment containing electrical ports for connection to communication devices and power supply, and an exposed easily accessible compartment for connecting cables to the respective ports through the work surface of the table. Cables can be connected beneficially to the electrical ports at an angle of approximately 45 degrees, thus ensuring easy use of the said receptacle. Furthermore, this patent suggested the use of a longitudinally hinged cover plate. In the closed position the cover plate is substantially flush with the work surface of the table. The cover plate is opened whenever a connection of the computer and/or communication devices needs to be removed or established. The cover plate rotates about its longitudinal side on which the hinge is assembled. In the open position, however, the cover plate protrudes in a disadvantageous way, egressing completely above the work surface.

PRESENTATION OF THE INVENTION

The invention is an attempt to avoid the above-mentioned disadvantages of the familiar state of the art. It is based on the task of developing a table flap for a table, which can easily be opened and closed, which is flush with the work surface of the table in the closed position. In the open position, it should permit unproblematic use of the electrical receptacle attached to its underside, as well as avoiding protruding of the table flap into the working space above the work surface of the table.

Based on the invention, this is accomplished on a table flap according to the preamble of Patent claim 1 in that the table flap in the open position can be both inclined and recessed at the same time.

The benefits of the invention consist in the fact that in the open position the table flap does not protrude into the working space above the work surface of the table, thus causing no inconvenience. Simultaneous inclination and recessing of the table flap allows easy operation of the electrical receptacle attached to its underside.

It is useful when a side guide is arranged at each side of the underside of the table flap, each side guide being provided with two guide webs, which can move along horizontal and substantially vertical guide slots. The latter are fixed in the holding elements that are attached underneath the work surface of the table.

Furthermore, it is useful when the horizontal guide slots are parallel to the work surface of the table, and the substantially vertical guide slots are arched. It is also useful when the table flap is connected to a compression spring by means of a kinematic constraint, via one of the guide webs moving in the arched guide slot. This allows easy and precise opening and closing of the table flap.

Finally, it is useful when the device for connecting various electric appliances and communication facilities is a receptacle, which can be installed in a clamp underneath the work surface of the table, and can be exchanged easily if necessary. This way office equipment can be rearranged promptly according to the specific conditions. The same can be achieved by attaching the device for connecting various electric appliances and communication facilities underneath the work surface of the table with a fixing screw. In this case, the device can easily be exchanged by loosening the fixing screw, and no clamp will therefore be needed.

The table flap is beneficially equipped with a relief. On the one hand, this allows easy opening of the table flap in that the user reaches into this opening causing the table flap to recess and to incline by pushing it. On the other hand, this provides enough space for the connecting cables to pass through when the table flap is in the closed position.

BRIEF DESCRIPTION OF THE DRAWING

The drawings depict two embodiments of the invention which show.

Only elements that are important for gaining an understanding of the invention are shown. The same reference numerals are used for identical parts throughout all figures.

WAYS OF EXECUTING THE INVENTION

The following describes the invention more in detail based on a sample embodiment and the FIGS. 1 through 8.

Figure 1:
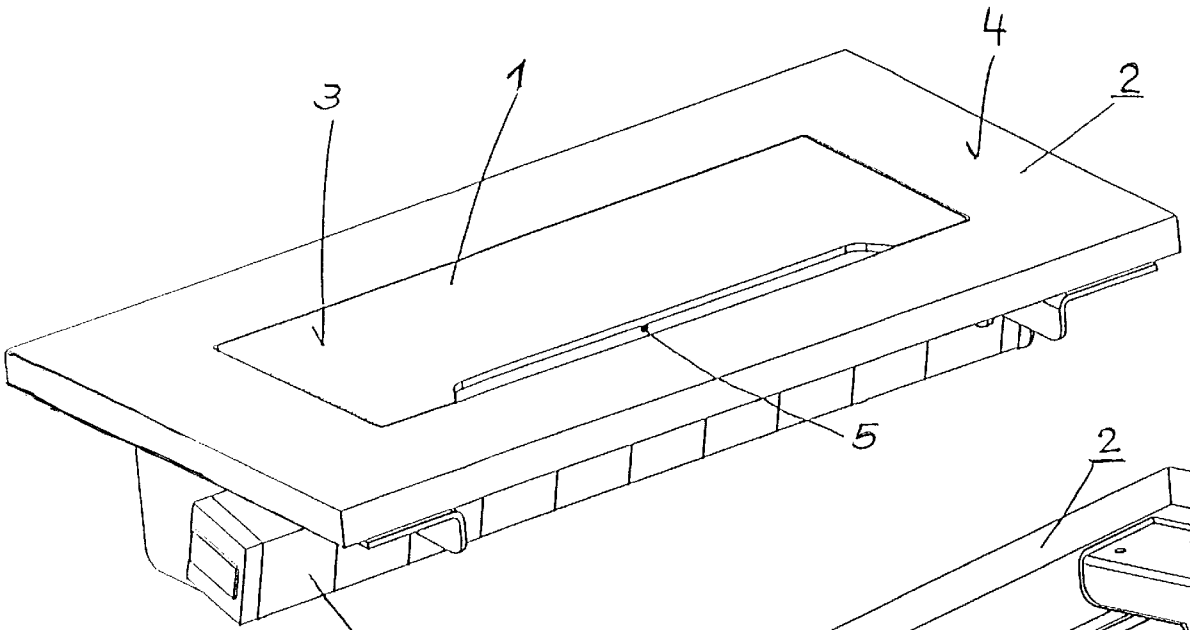
FIG. 1 a perspective view of the invented table flap assembled on a table in the closed position (a plan view)
Figure 2:
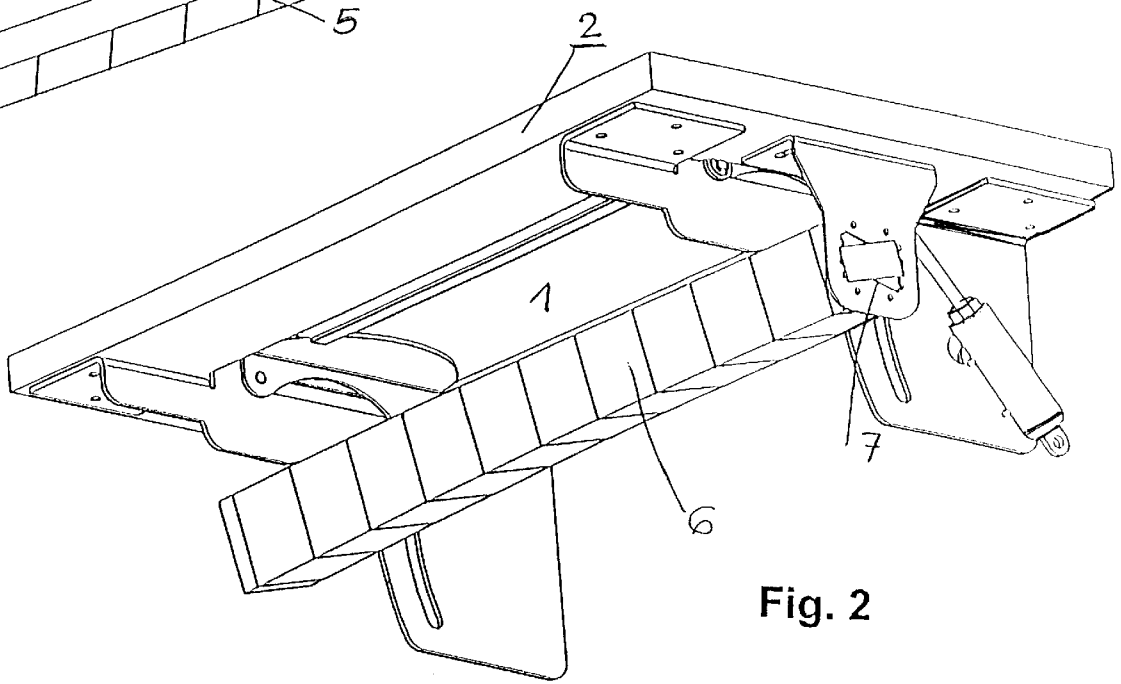
FIG. 2 a perspective view of the invented table flap assembled on a table in the closed position (a bottom view) according to the first embodiment of the invention.

Both FIG. 1 and FIG. 2 depict a perspective view of the invented table flap assembled on a table in the closed position according to the first embodiment of the invention, wherein FIG. 1 shows a plan view, and FIG. 2 a bottom view. For better understanding of the invention both figures should be viewed together.

According to FIG. 1 and FIG. 2, the table flap 1 is integrated in a table 2, an office desk, for instance. The upper side of the table flap 1 and the work surface 4 of the table 2 are flush when the table flap 1 is in the closed position, i.e. the upper side 3 of the table flap 1 can then be used beneficially as a work surface. The table flap 1 has a relief 5 on its longitudinal side. The relief 5 can extend either along only a portion of the table flap side (see FIG. 1) or along the whole length of the side and, if necessary, can be covered with an additional element that has to be fitted accordingly. The relief 5 allows, on the one hand, an easy opening of the table flap 1 in that the user reaches into the relief 5 and pushes the table flap 1, causing it to recess and to incline. On the other hand, the relief 5 provides enough space for the connecting cables etc. when the table flap 1 is in the closed position. Such connecting cables should be plugged into a device 6 for connecting various electric appliances and communication facilities. In the present sample embodiment, the device 6 is a receptacle for connecting electrical and communication interface cables that is fixed in a clamp 7 arranged underneath the work surface 4 of the table 2, which cannot be viewed in FIG. 1 (cf. FIG. 2). Open sides provide enough free space to permit easy exchanging of the receptacle 6 and, therefore, adaptation of the workplace to different office equipment.

Figure 3:
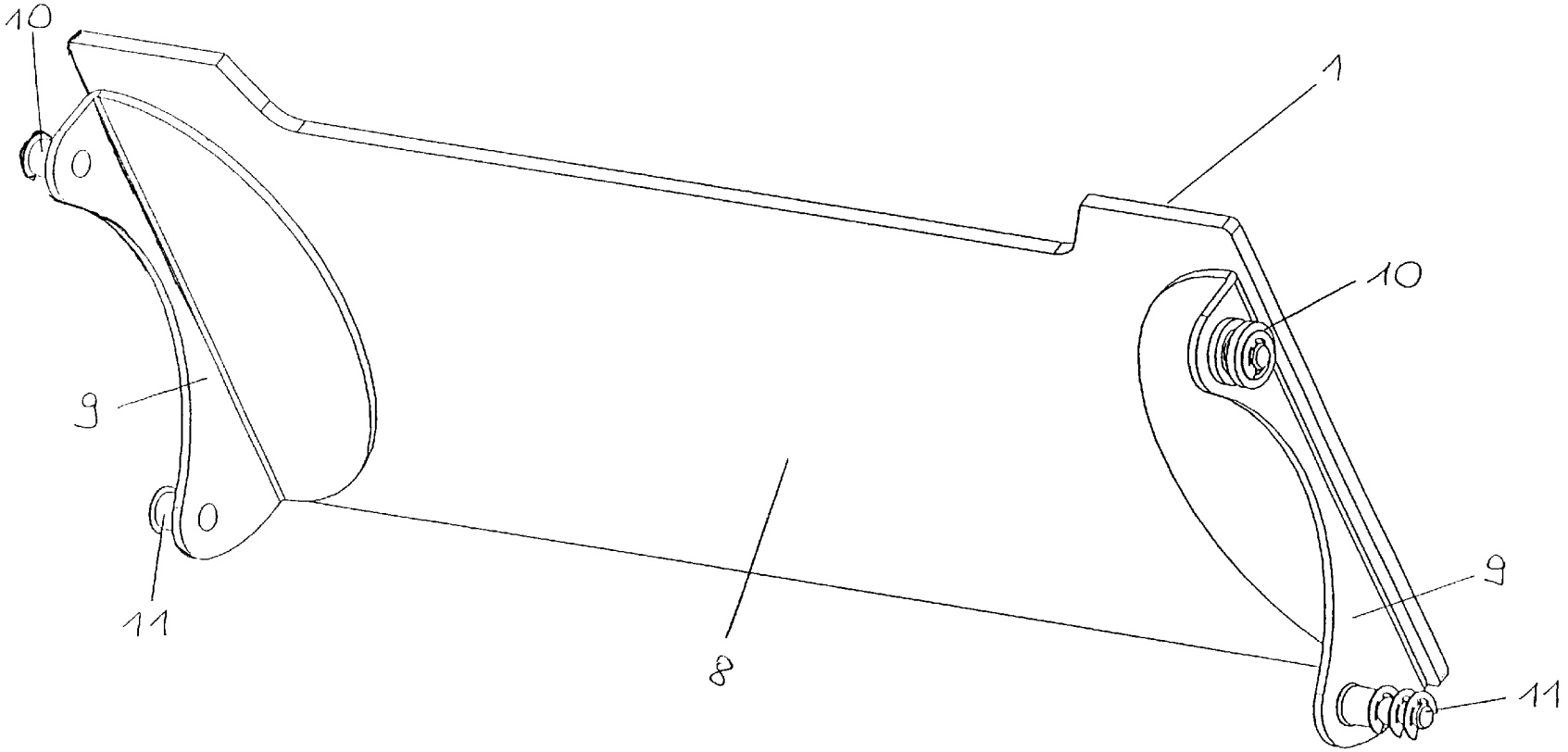
FIG. 3 a perspective view of the invented table flap (a bottom view), as per FIG. 2.

FIG. 3 shows a perspective view of the table flap alone in accordance with FIG. 1 and FIG. 2. One can see that two side guides 9 with two guide webs 10, 11 are arranged on the underside 8 of the table flap 1.

Figure 4:
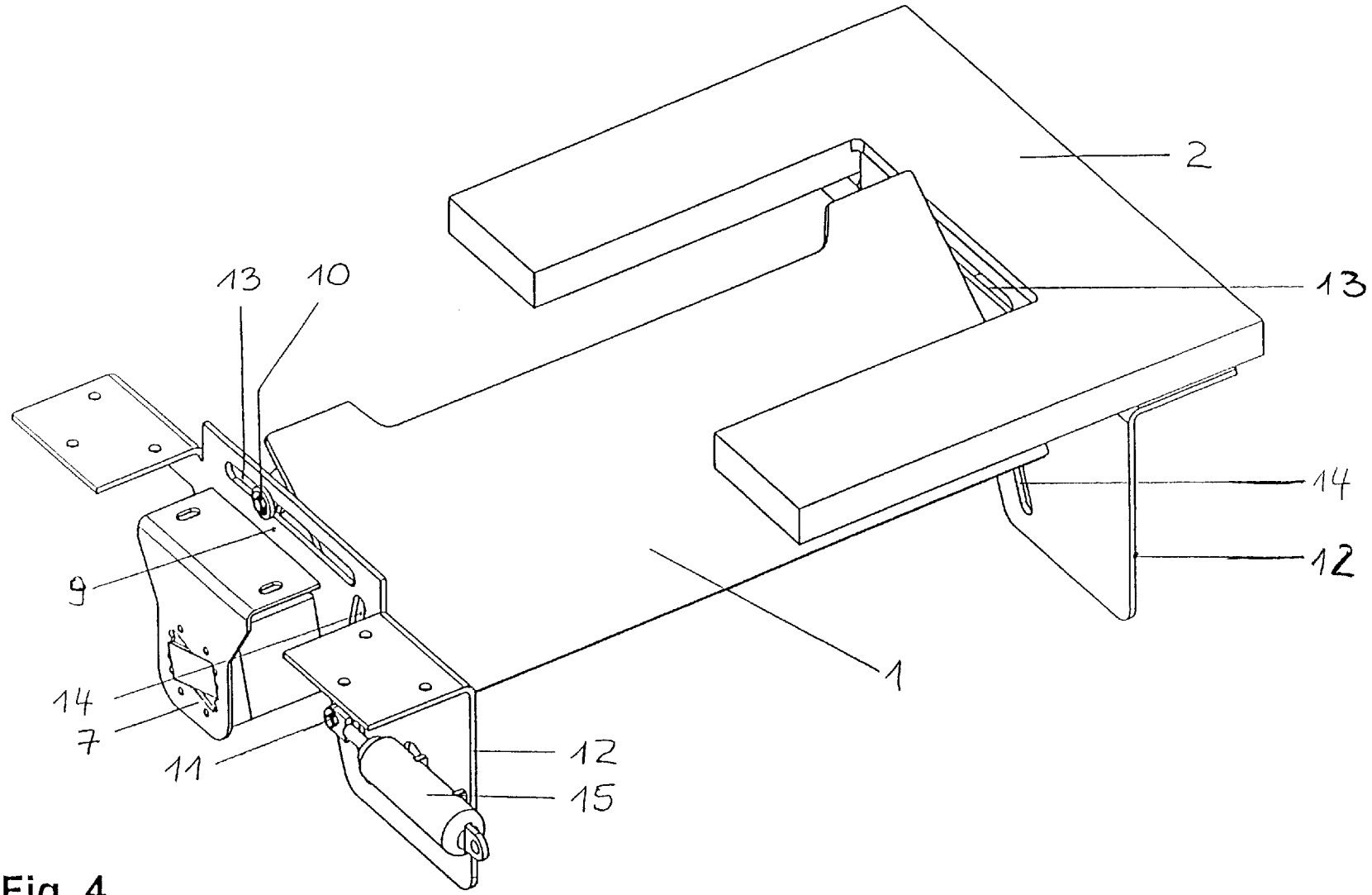
FIG. 4 a perspective view of the invented table flap as per FIG. 2 assembled on a table, in a slightly open position (a lateral bottom view)

As shown in FIG. 4, two lateral holding elements 12 are attached to the table top underneath the work surface 4 of the table, each having a horizontal guide slot 13 and a substantially vertical guide slot 14. Both holding elements 12 are attached to the table 2 in such a way that the guide webs 10, 11 of the side guides 9 of the table flap 1 can move in the guide slots 13, 14 of the holding elements. The horizontal guide slots are parallel to the work surface 4 of the table 2, and the substantially vertical guiding slots 14 are arched, wherein the arch opens backwards relative to the user. The guide web 11 that moves in the substantially vertical arched guide slot 14 is connected to a compression spring 15 so that the compression spring 15 is directed in the guide slot 14 along the arched path whenever the table flap 1 is being opened. The center of rotation 16 of the compression spring 15 should be selected so as to allow the table flap 1 to regain its horizontal position when it is closed. The use of the compression spring 15 contributes to comfortable and easy operation of the table flap 1.

Figure 5:
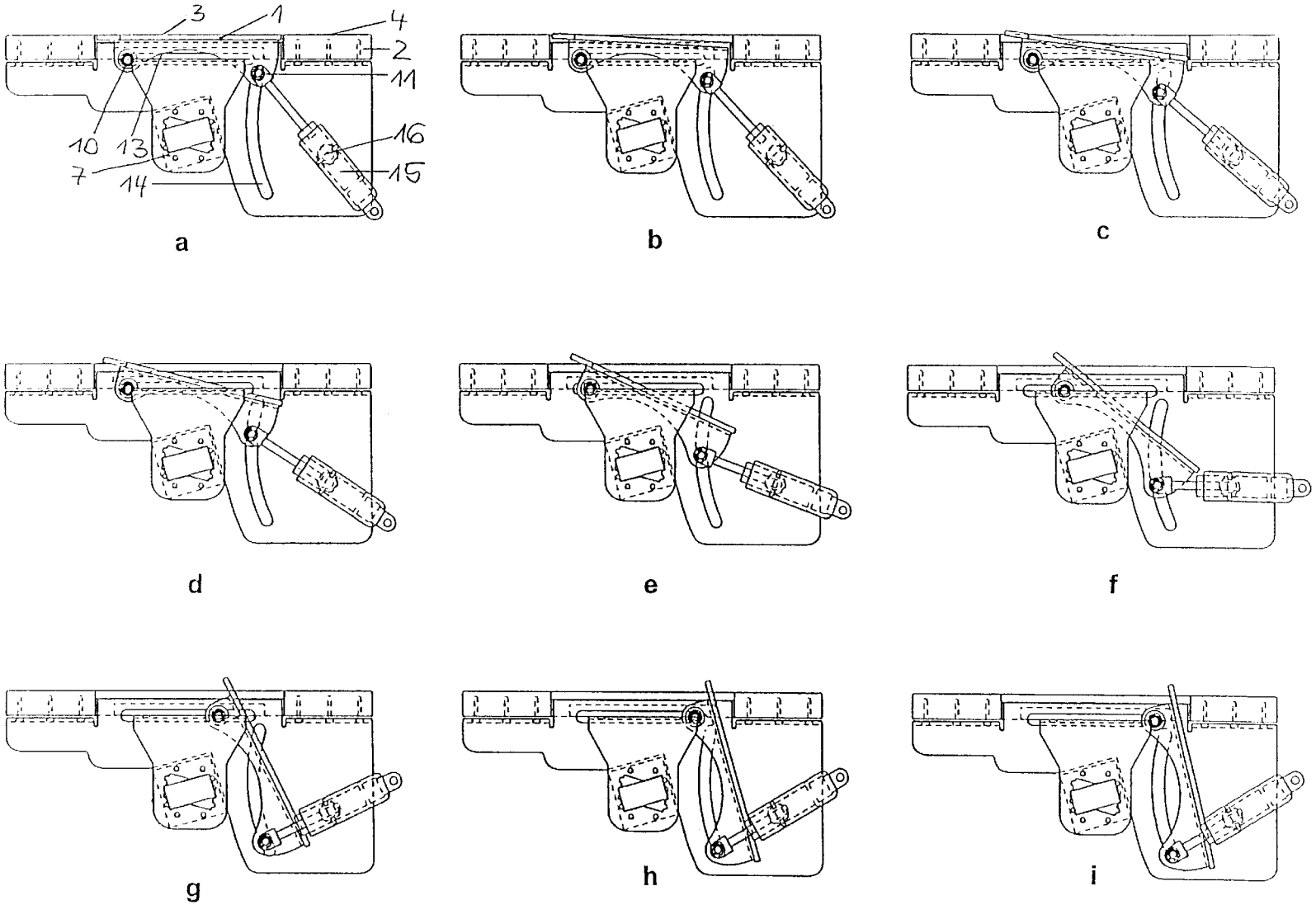
FIGS. 5*a–i* side views of the invented table flap as per FIG. 2, which depict in detail the movement of the table flap between the open and the closed position.

FIG. 5 shows nine side views of different stages of the opening cycle of the table flap 1. FIG. 5*a* depicts the table flap 1 in the closed position, and FIG. 5*i* in the completely open position. FIGS. 5*b* through 5*h* show the intermediate stages.

As shown in FIG. 5*a*, in the closed position the upper side 3 of the table flap 1 is flush with the work surface 4 of the table 2. The table flap 1 is positioned horizontally. The guide web 10 is positioned at the leftmost end of the horizontal guide slot 13, whereas the guiding web 11 is positioned at the highest point of the arched guide slot 14. The compression spring 15 is connected to the guide web 11. This is the most vertical position of the compression spring, where its angle to the horizon is approximately 45 degrees.

FIGS. 5*b* through 5*h* show intermediate positions during opening. During opening the table flap 1 is being inclined and recessed simultaneously, i.e. the guide web 11 is being moved slowly to the right in the horizontal guide slot 13. At the same time, the compression spring 15 with the guide web 11 is being directed downwards in the arched guide slot 14. In this way the compression spring 15 rotates about its fixed center of rotation 16. For instance, FIG. 5*f* illustrates its horizontal position. The opening angle of the table flap 1 increases until it reaches nearly 90 degrees in the final position (see FIG. 5*i*). In the completely open position the guide web 10 reaches the right end of the guide slot 13, whereas the guide web 11 connected to the compression spring 15 attains the lowest point in the guide slot 14. Now the table flap 1 provides a sufficiently large opening for trouble-free operation of the device 6. On the other hand, the simultaneous inclination and recessing of the table flap 1 is beneficial in preventing the table flap 1 from protruding into the working space above the work surface 4 of the table 2.

Of course, the invention is not limited to the described first sample embodiment.

Figure 6:
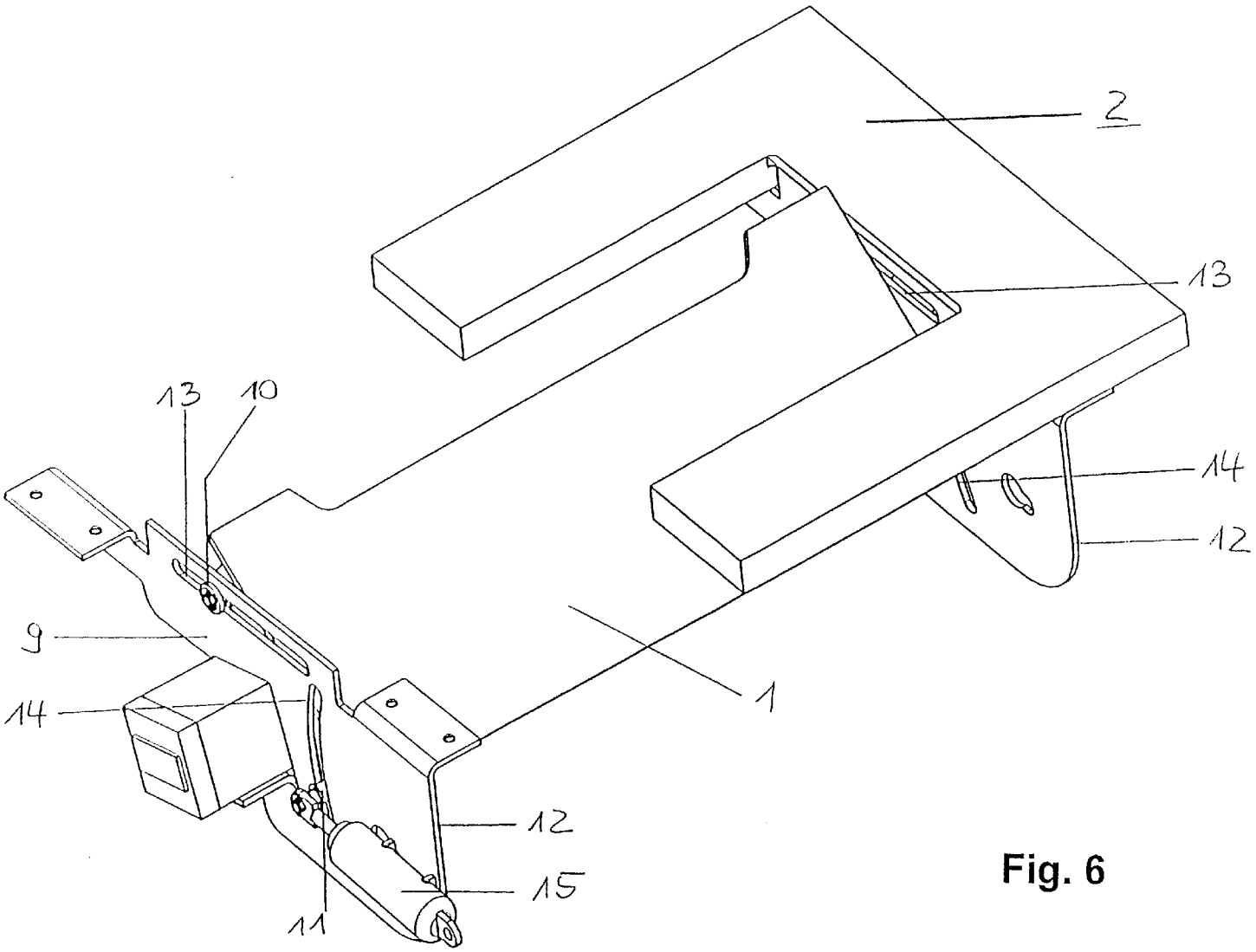
FIG. 6 a perspective view of the invented table flap assembled on a table, in a slightly open position (a lateral bottom view) according to the second embodiment of the invention.
Figure 7:
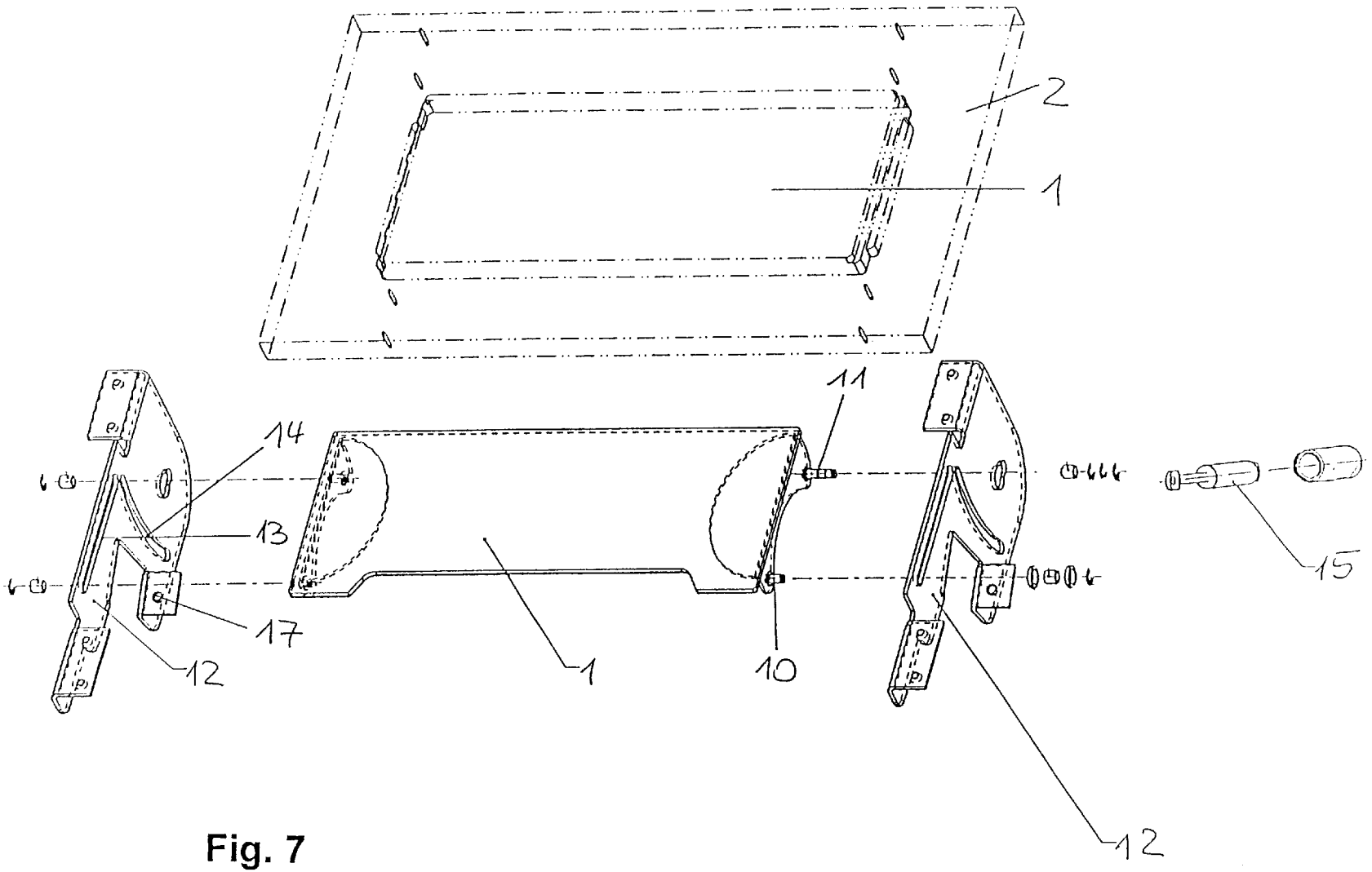
FIG. 7 an exploded view of FIG. 6.
Figure 8:
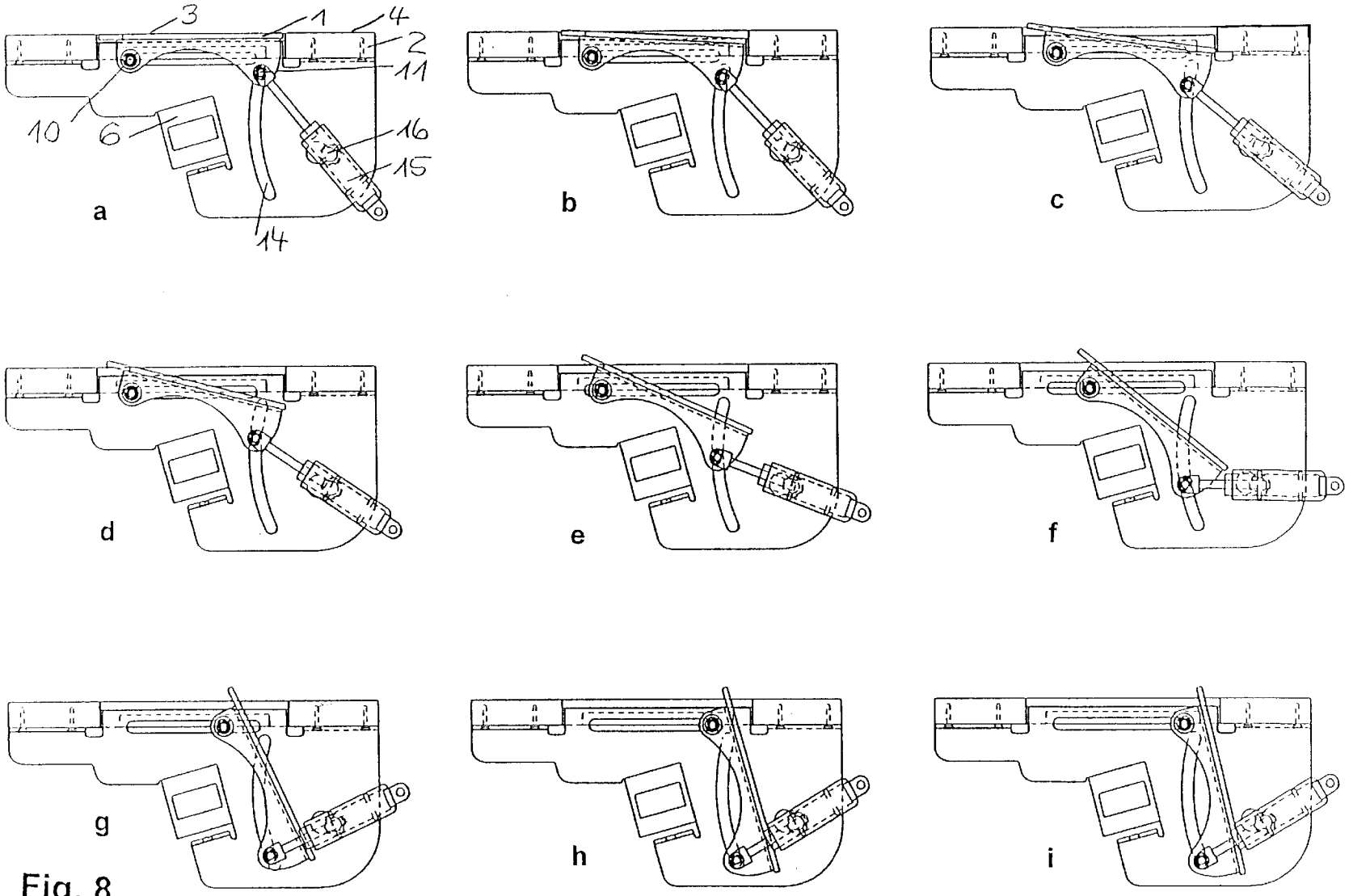
FIGS. 8*a–i* side views of the invented table flap according to FIG. 6, which depict in detail the movement of the table flap between the open and the closed position.

FIGS. 6 through 8 present the second sample embodiment of the invention. FIG. 6 shows a perspective view of the invented table flap 1 assembled on a table 2, in a slightly open position. The only difference between the second sample embodiment and the first sample embodiment of the invention depicted in FIG. 2 consists of the fact that the former does not have a clamp 7 for fixing the receptacle 6 underneath the tabletop. As shown in the exploded view in FIG. 7, the receptacle 6 is affixed to the side holding elements 12 with fixing screws 17. In the horizontal projection (plan view) the table 2 looks exactly the same as depicted in FIG. 1.

FIG. 8 shows nine side views of the different stages of the opening cycle of the table flap 1 according to the second sample embodiment. FIG. 8*a* depicts the table flap 1 in the closed position, and FIG. 8*i* shows it in the completely open position. FIGS. 8*b* through 8*h* show the intermediate stages. By analogy, the comments already made earlier regarding FIG. 5*a* through FIG. 5*i* should be consulted.

What is claimed is:

1. A movable table flap that can adapted to be integrated into a work surface of a table, wherein in a closed position thereof an upper side of the table flap is flush with the work surface of the table and a device (6) for connecting various electric appliances and communication facilities is arranged underneath the table flap, which comprises a device connected to the table for simultaneously inclining and lowering the table flap with respect to the work surface of the table in an open position of the table flap.

2. Table flap pursuant to claim 1, which comprises side guide holding elements positioned on an underside (8) of the table flap, said guide holding elements each including two guide webs which are moveable in horizontal and substantially vertical guiding slots, wherein the said guide slots are to formed in the holding elements and the holding elements are fixed to the table underneath the work surface of the table.

3. Table flap pursuant to claim 2, wherein the horizontal guide slots are parallel to the work surface of the table, and the substantially vertical guide slots are arched shaped.

4. Table flap pursuant to claim 2 wherein the table flap is connected to a compression spring by a kinematic constraint via one of the guide webs that moves in the arched guide slot.

5. Table flap pursuant to any one of claims 1 through 4, wherein the device for connecting various electric appliances and communication facilities comprises a receptacle which can be installed and fixed in via a clamp underneath the work surface of the table and which can easily be exchanged.

6. Table flap pursuant to any one of the claims 1 4, wherein the device for connecting various electric appliances and communication facilities comprises a receptacle which can be affixed underneath the work surface of the table with a fixing screw and which can be exchanged, by loosening the fixing screw.

7. Table flap pursuant to one of the claims 1 through 4, wherein the table flap is equipped with a relief.

8. Table flap pursuant to claim 1, wherein substantially all of the table flap is lowered by said device for inclining and lowering the table flap with respect to the surface of the table.

9. A movable table flap adapted to be integrated into a work surface of a table wherein in a closed position thereof an upper side of the table flap is flush with the work surface of the table and a device for connecting various electrical appliances and communications facilities is arranged underneath the table flap, which comprises a device connected to the table for inclining and lowering the table flap with respect to the work surface of the table wherein side guide holding elements are positioned on an underside portion of the table flap, said side guide holding elements each including two guide webs, said guide webs being movable in a horizontal and substantially vertical guiding slot formed in the holding elements and said holding elements are fixed underneath the work surface of the table.

10. A table flap pursuant to claim 9, wherein the horizontal guide slots are parallel to the work surface of the table and the substantially vertical guide slots are arched.

* * * * *

UNITED STATES PATENT AND TRADEMARK OFFICE

CERTIFICATE OF CORRECTION

PATENT NO. : 6,732,661 B2
DATED : May 11, 2004
INVENTOR(S) : Klaus-Peter Grasse et al.

It is certified that error appears in the above-identified patent and that said Letters Patent is hereby corrected as shown below:

Column 4,
Line 58, delete "(6)" and
Line 65, delete "(8)".

Signed and Sealed this

Twenty-first Day of September, 2004

JON W. DUDAS
*Director of the United States Patent and Trademark Office*